US011077007B2

(12) United States Patent
Collie, Jr.

(10) Patent No.: US 11,077,007 B2
(45) Date of Patent: Aug. 3, 2021

(54) PERSONAL CARE STATION EMPLOYING MOBILE PROVIDER SEAT AND FIXED CLIENT SEAT

(71) Applicant: Phillip Collie, Jr., Washington Courthouse, OH (US)

(72) Inventor: Phillip Collie, Jr., Washington Courthouse, OH (US)

( * ) Notice: Subject to any disclaimer, the term of this patent is extended or adjusted under 35 U.S.C. 154(b) by 378 days.

(21) Appl. No.: 16/126,857

(22) Filed: Sep. 10, 2018

(65) Prior Publication Data

US 2020/0078249 A1 Mar. 12, 2020

(51) Int. Cl.

| | |
|---|---|
| ***A61G 15/08*** | (2006.01) |
| ***A47C 1/06*** | (2006.01) |
| ***A47C 1/08*** | (2006.01) |

(52) U.S. Cl.

CPC ..... *A61G 15/08* (2013.01); *A47C 1/06* (2013.01); *A47C 1/08* (2013.01)

(58) Field of Classification Search

CPC ..... A61G 15/08; A47C 1/06; A47C 1/08
See application file for complete search history.

(56) References Cited

U.S. PATENT DOCUMENTS 2,212,388 A * 8/1940 Cheney ..... B66B 9/0815 187/201
2,694,439 A * 11/1954 Murray ..... A47C 1/06 297/240
2,719,607 A * 10/1955 Scott ..... B66B 9/083 187/202
2,888,099 A * 5/1959 Hoffmann ..... B66B 9/0838 187/202
4,555,138 A * 11/1985 Hughes ..... A47C 9/022 296/65.14
4,840,000 A * 6/1989 Grines ..... A45D 44/02 297/344.1
4,849,000 A 6/1989 Grines
5,028,016 A * 7/1991 Kelvin ..... B64D 11/00155 244/122 R
6,360,833 B1 * 3/2002 Valencia ..... A61G 5/061 180/7.5
2005/0224293 A1 * 10/2005 Molnar ..... B66B 9/0807 187/200
2012/0073908 A1 * 3/2012 Rosenthal ..... B66B 9/0846 187/201
2012/0086257 A1 * 4/2012 Wald ..... A47C 7/5064 297/423.19

(Continued)

*Primary Examiner* — Jason C Smith
(74) *Attorney, Agent, or Firm* — R. William Graham

(57) ABSTRACT

An apparatus for aiding service providers who service customers situated in a relatively fixed position includes a floor, an elevated customer support surface disposed in a first position on the floor, a curved rail connected to the floor in a fixed position about the elevated customer support surface at the first position having a first end with a stop and a second end with a stop. A powered roller mechanism operably connects to the curved rail surface having a chair support surface maintained above the rail and limited in travel between the stops. A service provider chair for handling a customer on the customer support surface is mounted to the chair support surface in a manner to be movable along the rail and a controller on the chair operably connects to the powered roller mechanism for controlling movement of the chair along the rail.

10 Claims, 1 Drawing Sheet

(56) References Cited

U.S. PATENT DOCUMENTS

| | | | | |
|---|---|---|---|---|
| 2013/0187021 | A1* | 7/2013 | Trendelkamp | A47C 3/00 248/429 |
| 2014/0151157 | A1* | 6/2014 | Hall | B66B 9/0853 187/202 |
| 2015/0034423 | A1* | 2/2015 | Ooms | B66B 9/0846 187/201 |
| 2015/0068847 | A1* | 3/2015 | Ooms | B66B 9/08 187/201 |
| 2015/0107939 | A1* | 4/2015 | Ooms | B66B 9/0853 187/201 |
| 2020/0078249 | A1* | 3/2020 | Collie, Jr. | A47C 1/11 |
| 2020/0242284 | A1* | 7/2020 | Schierenbeck | B66B 9/08 |

* cited by examiner

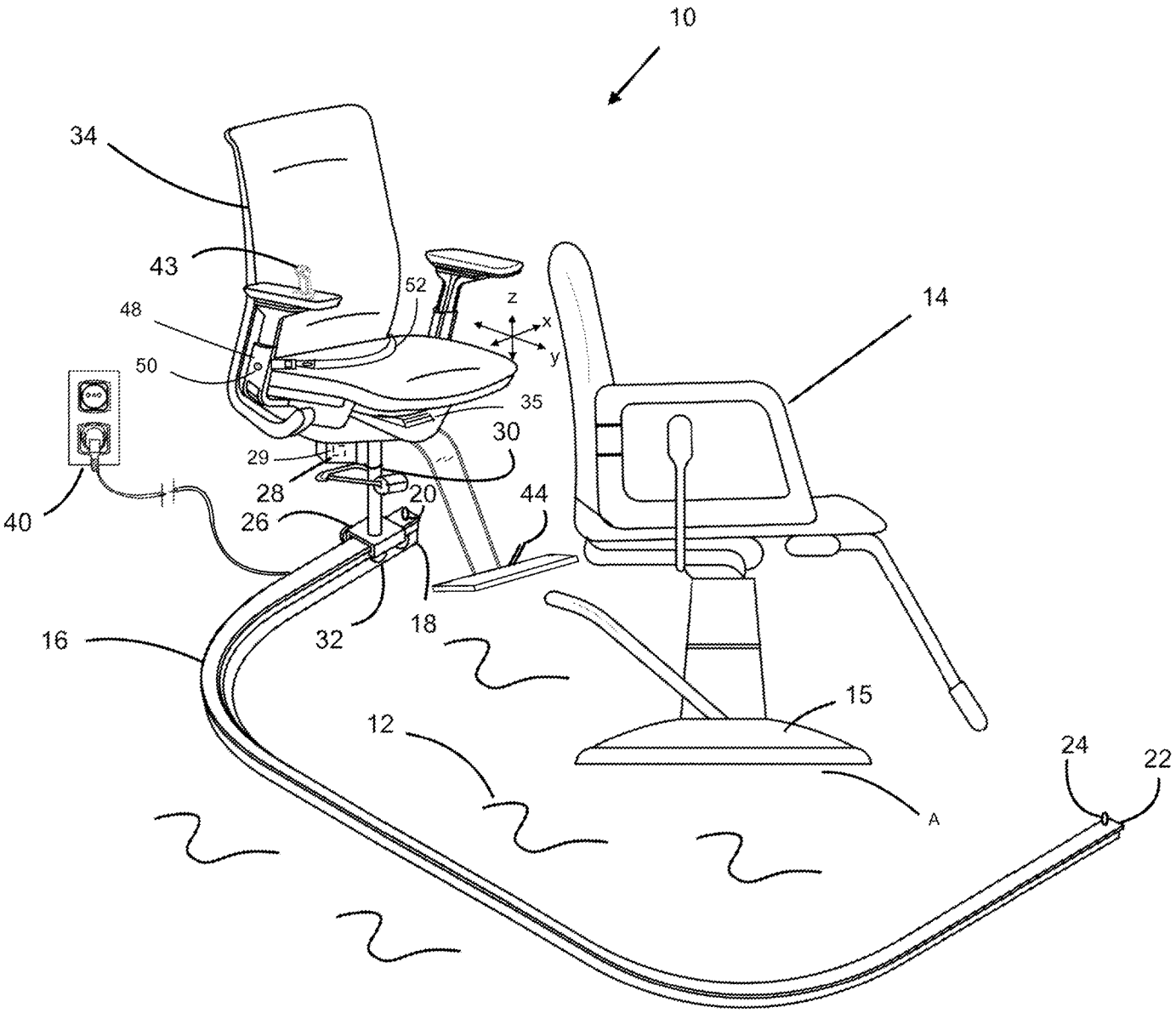
10
14
15
A
22
24
12
16
18
20
32
26
28
29
30
35
44
52
x
y
z
34
43
48
50
40

PERSONAL CARE STATION EMPLOYING MOBILE PROVIDER SEAT AND FIXED CLIENT SEAT

BACKGROUND OF INVENTION

Field of Invention

The present invention relates to the field of servicing customers in a chair or table. More particularly, the invention relates to a system for aiding service providers who service customers situated in a relatively fixed position.

Prior Art

The present invention relates to servicing a client who is generally situated in a fixed position, such as in a chair or table, wherein the service provider moves about the client in order to provide a particular service or treatment. This can range from barber shop, hair and nails salons, dentist, surgery room or other similar situations where the service provider is required to move about the client. By way of example, the invention will discuss an exemplary application with the understanding of the application to other service providers. In the case of cutting hair, the customer's hair is cut without moving the customer and the barber or hair stylist moves about the customer in order to service him/her and this currently requires the service provide to remain on their feet a significant part of their day. In many case, the service provider develops ailments as a result of work conditions, such as plantar fasciitis, leg, back and neck issues.

There is a need to alleviate the stress caused on the provider's body in such working environments. The instant invention addresses these concerns and a solution to alleviate such conditions.

Conventionally, in a barber shop, there is a customer chair which is stationary. The barber typically moves around the customer on his feet to gain access to the front, sides and rear of the customer. The barber is on his/her feet for 8-10 hours a day in a relatively limited range of movement causing stress on legs and feet. This is true of the other vocations mentioned above.

In conventional equipment, the barber or salon may perform all of the work without moving the customer. Also, conventionally, hair cutting, styling, shampooing and drying can be carried out in a single chair. Most of the improvements in the field have been centered around maximizing space in such environment so there is no wasted space, to improve the workability of such space.

SUMMARY OF INVENTION

It is an object to improve the work environment in the field of servicing customers in a chair or table.

Another object is to improve the environment and system for aiding service providers who service customers situated in a relatively fixed position.

Still another object is to reduce potential injury and ailments associated with standing on one's feet in a work environment in the field of servicing customers in a fixed chair or table.

Accordingly, the instant invention is directed to an apparatus for aiding service providers who service customers situated in a relatively fixed position includes a floor, an elevated customer support surface disposed in a first position on the floor, a curved rail connected to the floor in a fixed position about the elevated customer support surface at the first position having a first end with a stop and a second end with a stop. A powered roller mechanism operably connects to the curved rail surface having a chair support surface maintained above the rail and limited in travel between the stops. A service provider chair for handling a customer on the customer support surface is mounted to the chair support surface in a manner to be movable along the rail and a controller on the chair operably connects to the powered roller mechanism for controlling movement of the chair along the rail.

BRIEF DESCRIPTION OF THE DRAWINGS

FIG. 1 is a schematic of the apparatus of the invention.

DETAILED DESCRIPTION OF THE INVENTION

Referring now to the drawing, the an apparatus for aiding service providers who service customers situated in a relatively fixed position is generally designated by the numeral 10. For the exemplary embodiment, the invention will refer to a service provider as being anyone of the type which fits the case of providing a personal service, be it personal hygiene, therapy, dental or medical treatment.

The apparatus 10 includes a floor 12 and an elevated customer support surface 14, which by way of example is shown here as a barber or salon chair, however it is contemplated that another support, operating or treatment table can be employed. The customer chair 14 has a base 15 disposed in a first position Aon the floor 12 which is preferably fixed. The chair 14 can be height adjustable as is known in the art. A curved rail 16 connects to the floor 12 in a second fixed position about the elevated customer chair 14 and first position A at the predetermined position within a service shop and has a first end 18 with a stop 20 and a second end 22 with a stop 24.

A powered roller mechanism 26 operably connects to the curved rail 16. The powered roller mechanism 26 has a housing 28 containing a power pack 29, e.g. battery, supported on a vertical pneumatic shaft 30 providing for height adjustability. Additionally, the shaft 30 can be comprised of multiple parts with a bearing surface to permit rotation between the parts. The roller mechanism 26 has a plurality of support shafts fixed to small brushless dc hub motors powering a set of wheels 32 on the rail 16. The power pack 29 serves to drive the movement of the roller mechanism 26.

A service provider seat or chair 34 for attending to a customer on the customer chair 14 is mounted to a service provider chair support surface 34 on the vertical pneumatic shaft 30 and can be fixed in position facing the customer chair 14 in a manner to be movable along the rail 16 and always facing the customer. The service provider chair 34 is movable along rail 16 by way of a power pack 29 which can be periodically charged via an electrical source 40 and controlled by a controller such as a joy stick 43 or a foot pedal 44 thereby providing the service provider seat 34, and hence service provider, to move about the fixed customer chair 14, and customer, within the area A and provide service while both are seated. The controller 43/44 on the chair 46 operably connects to the powered roller mechanism 26 for controlling lateral movement of the chair 46 along the rail 16. The joy stick 43 can also control other forward and backward movement across and normal to the axis of the rail 16 as set forth below, thus providing an x-y-z axis movement.

The service provider chair 34 is maintained above the rail 16 and connects to the vertical pneumatic shaft 30 and can be adjusted vertically to a desired height. The vertical pneumatic shaft 30 can be electrically powered or hand pumped. The service provider chair 34 is limited in travel between the stops 20 and 24. Both chairs 14 and 34 are equipped to swivel and lock in a desired position as is known in the art. The service provider chair 34 can include one or more track connection(s) 35 having a threaded screw and drive mechanism connected thereto which provides limited forward and backward travel relative to the rail 16 to suit the particular user's needs and controlled by the joy stick 43 and operably connected the power pack 29.

As a safety mechanism, there are disposed on arms 48 motion sensors 50. The motion sensors 50 can be operably connected to the power pack 29 to cause travel to stop when someone is passing in front of the direction of travel. As an additional safety precaution, there can be provided a seat belt 52 to the service provider chair 34.

By so providing, the invention reduces the back, leg and foot stress associated with such service providers which heretofore were required to remain on the feet for extending periods of time. The embodiment is considered as illustrative only of the principles of the invention. Numerous modifications and changes will readily occur to those skilled in the art, and it is not desired to limit the invention to the exact construction and operation shown and described, and accordingly, all suitable modifications, and equivalents which may be resorted to, fall within the scope of the invention.

What is claimed is:

1. An apparatus for aiding service providers who service customers situated in a relatively fixed position, comprising;

a floor having an upper surface;

a customer chair fixed in an area A on said floor;

an elevated customer support surface disposed in first position on the upper surface;

a curved rail connected to the floor in a fixed position about the elevated customer support surface and area A having a first end with a stop and a second end with a stop;

a powered roller mechanism operably connected to said curved rail surface having a service provider chair support surface mounting surface above said rail and is limited in travel thereof between said stops;

a service provider seat for handling a customer on said customer support surface, said service provider seat mounted to said service provider seat support surface in a manner to be movable along said rail; and a controller is operably connected to said powered roller mechanism for controlling movement of said service provider seat along said rail thereby providing the service provider seat to move about said fixed customer chair and said area A in a manner such that a service provider disposed in said service provider seat can provide service to a customer situated in said customer seat while seated at any point alone said rail.

2. The apparatus of claim 1, wherein said controller is a joy stick.

3. The apparatus of claim 1, wherein said controller is a foot pedal.

4. The apparatus of claim 1, wherein said curved rail extends around at least two sides of said elevated customer support surface.

5. The apparatus of claim 1, wherein said curved rail extends along at least three sides of said elevated customer support surface.

6. The apparatus of claim 1, wherein said powered roller mechanism includes brushless DC motorized wheels.

7. The apparatus of claim 1, whereby said seat may be selectively propelled along said rail a predetermined position along said rail.

8. The apparatus of claim 1, which includes a motion sensor operably connected to said service provider seat and said controller to stop travel of said powered roller mechanism upon sensing movement across said rail.

9. The apparatus of claim 1, which includes a seat belt operably connected to said service provider seat.

10. The apparatus of claim 1, which includes means operably connected to said service provider seat for moving said seat forward and backward relative to said rail.

* * * * *